US010683672B2

(12) United States Patent
Wang et al.

(10) Patent No.: US 10,683,672 B2
(45) Date of Patent: Jun. 16, 2020

(54) CONSTRUCTION METHOD FOR LIFTING STRUCTURE INTEGRALLY OVER THE OBSTACLES IN VERTICAL DIRECTION TO A POSITION WITH DIFFERENT HORIZONTAL PROJECTION

(71) Applicants: Guangzhou Construction Engineering Co., Ltd., Guangzhou (CN); Shanghai YeSheng Mechanical & Electrical Control Technology Co., LTD, Shanghai (CN)

(72) Inventors: Long Wang, Guangzhou (CN); Wei Wei, Shanghai (CN); Junyue Gao, Guangzhou (CN); Jianming Wen, Shanghai (CN); Sui Yin, Guangzhou (CN); Yuantao Zhao, Shanghai (CN); Yanfeng Jia, Shanghai (CN)

(73) Assignees: GUANGZHOU CONSTRUCTION ENGINEERING CO., LTD., Guangzhou (CN); SHANGHAI YESHENG MECHANICAL & ELECTRICAL CONTROL TECHNOLOGY CO., LTD, Shanghai (CN)

( * ) Notice: Subject to any disclaimer, the term of this patent is extended or adjusted under 35 U.S.C. 154(b) by 935 days.

(21) Appl. No.: 15/071,682

(22) Filed: Mar. 16, 2016

(65) Prior Publication Data

US 2016/0194888 A1 Jul. 7, 2016

Related U.S. Application Data

(62) Division of application No. 14/032,928, filed on Sep. 20, 2013, now Pat. No. 9,441,383.

(30) Foreign Application Priority Data

May 23, 2013 (CN) ..... 2013 1 0196541

(51) Int. Cl.
*B66C 17/06* (2006.01)
*E04G 21/16* (2006.01)

(52) U.S. Cl.
CPC ..... *E04G 21/167* (2013.01); *B66C 17/06* (2013.01)

(58) Field of Classification Search
CPC .. B66C 17/06; B66C 5/00; B66C 5/02; B66C 5/04; B66C 5/06; B66C 11/16; B66C 11/22; B66C 11/00; E04G 21/167
(Continued)

(56) References Cited

U.S. PATENT DOCUMENTS 3,176,853 A 4/1965 Baudhuin
3,262,580 A * 7/1966 Markowitz ..... B66C 13/00 212/324

(Continued)

FOREIGN PATENT DOCUMENTS

CN 101328765 A 12/2008
CN 201649671 U 11/2010
CN 102490643 A 6/2012

*Primary Examiner* — Joshua J Michener
*Assistant Examiner* — James J Buckle, Jr.
(74) *Attorney, Agent, or Firm* — Muncy, Geissler, Olds & Lowe, P.C.

(57) ABSTRACT

A construction apparatus and method for lifting structure integrally over obstacles in vertical direction to a position with different horizontal projection. The apparatus has two platform beams placed each other in parallel, two lifting beams laterally relative to the platform beams and a lifter equipped with the lifting beams. Push instrument kits are installed on the platform beams and the lifting beams respectively, and a plurality of sets of baffles installed on both sides of the platform beams to provide the push instrument kits with a counter-force when the push instrument kits work. When the structure encounters obstacles during the process of lifting the structure by two lifters, the (Continued)

posture of the structure can be altered by operating the push instrument kits and the lifters, such that the horizontal projection of the structure will be reduced and the structure can therefore be lifted over the obstacle in vertical direction.

1 Claim, 8 Drawing Sheets

(58) Field of Classification Search
USPC ..... 52/745.2; 212/312, 319, 324; 414/561
See application file for complete search history.

(56) References Cited

U.S. PATENT DOCUMENTS 3,645,406 A * 2/1972 Brazell ..... B66C 1/223
180/264
3,784,028 A * 1/1974 Stewart ..... B66C 13/00
105/163.1
3,792,779 A 2/1974 Brazell
4,433,952 A * 2/1984 Glickman ..... B66C 19/00
180/9.46
5,715,958 A 2/1998 Feider
6,030,168 A 2/2000 Kroll
8,646,630 B2 * 2/2014 Franzen ..... B66C 19/002
212/312
8,651,793 B2 * 2/2014 Franzen ..... B65G 63/025
212/319
9,441,383 B2 * 9/2016 Wang ..... B66C 17/06

* cited by examiner

CONSTRUCTION METHOD FOR LIFTING STRUCTURE INTEGRALLY OVER THE OBSTACLES IN VERTICAL DIRECTION TO A POSITION WITH DIFFERENT HORIZONTAL PROJECTION

CROSS REFERENCE TO RELATED APPLICATIONS

This application is a Divisional of co-pending application Ser. No. 14/032,928, filed on Sep. 20, 2013, for which priority is claimed under 35 U.S.C. § 120; and this application claims priority of Application No. 201310196541.1 filed in China on May 23, 2013, under 35 U.S.C. § 119, the entire contents of all of which are hereby incorporated by reference.

FIELD OF TECHNOLOGY

The present invention relates to a apparatus for civil engineering, in particular to a construction apparatus and method for lifting a structure integrally over obstacles in vertical direction to a position with a different horizontal projection.

BACKGROUND OF THE INVENTION

With the development of society, and the increase of labor cost, negative influences of traditional construction models often occur. That is, high-altitude working environments have much potential risk and long construction periods and it is difficult to guarantee construction quality. Additionally, this results in high project costs.

Therefore, a construction method for lifting integrally transforms high-altitude working operations into a ground operation, which greatly reduces potential safety hazards, improves the working environment, ensures construction quality, and realizes prefabrication and mechanization of structure installation. Also, it improves construction efficiency, construction quality and security of construction procedure. This is especially important and meaningful to current structure construction under circumstance of raising labor cost and tight schedules. Furthermore, this positively impacts present construction production from a labor-intensive, extensive and backward construction mode into a technology-intensive, intensification and advanced construction mode.

However, existing integrally lifting construction methods are mostly performed in good condition of lifting point layout and construction environment. There is no corresponding integrally lifting construction method for installation in other conditions where the obstacles in a vertical direction exist or an initial lifting position and a placement position of the structure have different horizontal projections. In this case an assembly in bulk in high altitude is often adopted. This technique, however, has the following disadvantages:

(1) Large quantity of high-altitude working, high safety hazard, and difficulty to carry out the safety protection;

(2) Bad environment condition for welding, which makes it hard to guarantee construction quality;

(3) The high-altitude working, which is a bad operational environment condition for welding, leads to an inconvenient operation and long construction period on site.

SUMMARY OF THE INVENTION

The present invention provides a construction apparatus and method for lifting a structure integrally over obstacles in vertical direction to a position with a different horizontal projection, which alleviates the technical problems associated with integrally lifting when obstacles in a vertical direction exist.

With regard to the solution for the above defects, the present invention provides the a construction apparatus for lifting a structure integrally over obstacles in a vertical direction to a position with a different horizontal projection, the apparatus comprising at least two platform beams that are placed parallel to each other and spaced by a certain distance, and at least two lifting beams disposed laterally relative to the platform beams, and that are placed on the platform beams, and above the structure to be lifted. A slide rail is arranged on the platform beam. A lifter is equipped on the lifting beam by means of a shoulder beam. First push instrument kits are installed on the platform beams to move the lifting beams, each first push instrument kit including a head connected to the lifting beam, a body, and a base used to sustain the body. Second push instrument kits are installed on the lifting beams to move the shoulder beams, and the lifters are installed on the shoulder beams, each second push instrument kit including a head connected to the shoulder beam, a body, and a base used to sustain the body. A first set of baffles is installed on both sides of the slide rail of the platform beams, in order to provide the first push instrument kits with a counter-force when the first push instrument kits work. A second set of baffles is installed on the lifting beams in order to provide the second push instrument kits with a counter-force when the second push instrument kits work.

Further, for the sake of controlling a pace of the push instrument kit, the first set of baffles comprises a plurality of pairs of baffles disposed at intervals, wherein two baffles of each pair are set on both sides of the slide rail respectively. The second set of baffles comprises a plurality of pair of baffles disposed at an interval, two baffles of each pair are set on top surface of the lifting beams.

Further, with the purpose of making the structure more stable, the shoulder beam is a box structure equipped with a via hole, a connecting ear-plate and a bound plate, wherein a steel strand can pass through the via hole, and the connecting ear-plate is configured at the sides of the box structure and spread outward to connect to the second push instrument kit, and the bound plate is configured at the bottom of the box structure.

To facilitate the push instrument kit moving, the base of second push instrument kit comprises a base body, expansion members placed at both sides of the base body, and ear-plates spread outward from the base body that used to connect to the push instrument body. The base of the push instrument kit is "H"-shaped and its width is less than the distance between two baffles of each pair baffle set on the lifting beam, and the expansion members are "H"-shaped and extend outward to be supported on the pair of baffles on the lifting beam.

Further, to facilitate the lifting beam moving, the slide rail comprises a slide groove fixed to the platform beam, and a slider fixed to the lifting beam, the slider can be slid in the slide groove, the accessible area between the slider and the slide groove is smooth plane with polishing treatment and lubricating grease.

The lifting beams have a double-beam structure where the beams are combined by two strips of "T"-shaped steel and ear-plates are used to connect to the first push instrument kits and are arranged on the lifting beams.

Moreover, in order to prevent the steel strand from folding while lifting the structure, due to its delay relative to the move of the push instrument kit, a rotatable support is arranged between the shoulder beam and the lifter. The rotatable support comprises a spherical convex fixed to the base of the lifter and a load-bearing member is fixed to the surface of the shoulder beam. The load-bearing member has a spherical concave facing to and matching with the spherical convex.

A method for lifting a structure integrally over obstacles in a vertical direction and moving the same horizontally, comprises:

(1) assembling the structure to be lifted on the proper position of a construction site and setting lifting lugs onto the suitable positions of the structure according to the construction requirements;

(2) arranging two platform beams longitudinally above the structure to be lifted, setting a slide rail to each platform beam, and fixing a slide groove to each platform beam;

(3) placing two lifting beams on the platform beams laterally, fixing a slider onto the bottom of the lifting beam, and the slider will be placed into the slide groove correspondently;

(4) installing first hydraulic push instrument kits on the platform beams, wherein the head of the push instrument kit is connected to the lifting beam, the body of the push instrument kit is connected to the base of the push instrument kit which is supported on the corresponding baffles on both sides of platform beam;

(5) installing shoulder beams and second hydraulic push instrument kits onto the lifting beams, wherein the head of the push instrument kit is connected to the shoulder beam, the body of the push instrument kit is connected to the base of push instrument kit which is supported on the corresponding pair of baffles on the lifting beams, and a hydraulic lifter is arranged on the shoulder beam;

(6) connecting the hydraulic lifter to the lifting lug on the structure to be lifted by means of a lifting steel strand, while lifting the structure, the height between both ends of the structure can be increased, and the horizontal projection of the structure will be reduced only if adjusting the hydraulic lifters arranged at two lifting beams and the first hydraulic push instrument kits at two platform beams, such that the posture of the structure can be altered and the structure can therefore be lifted over the obstacle in the vertical direction;

(7) adjusting the height and the horizontal projection once again by operating the hydraulic lifters and the first hydraulic push instrument kits after the structure has already crossed over the obstacle, and making the structure to be horizontal, then the structure can be lifted to a target height thereafter;

(8) moving the structure to a desired position by operating second hydraulic push instrument kits, each pace of the hydraulic push instrument kits should match with the interval between two adjacent baffles installed on the lifting beam. Once the push instrument kit works to push at the shoulder beam for a stroke, two expansion members placed at both sides of the base body of the push instrument kit will be retracted, such that the push instrument kit can be taken out to next stroke, and two expansion members spread outward again to support on next pair of baffles on the next stroke, and the push instrument kit works again to push at the shoulder beam. Such operation can proceed subsequently, until the structure reaches its desired horizontal position;

(9) adjusting the structure slightly by means of a hydraulic lifter and completing installation of the structure.

Compared with the prior art, the present invention has a stable structure and high automaticity, which transforms high-altitude working into a ground operation, improves environmental conditions of manual operation, reduces potential dangerousness, shortens construction period, and ensures project quality and construction safety.

BRIEF DESCRIPTION OF THE DRAWINGS

The present invention will be further described in details hereinafter with the reference to accompanying drawings and exemplary embodiment, in which.

LIST OF REFERENCE CHARACTERS

Figure 1:
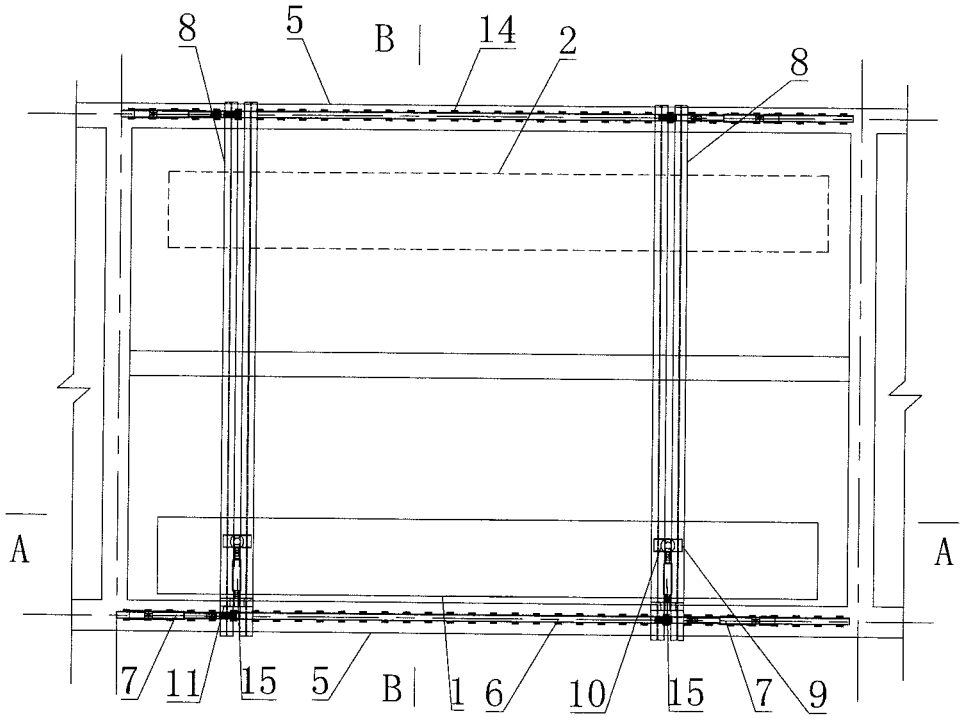
FIG. 1 is a top view according to the present invention.
Figure 2:
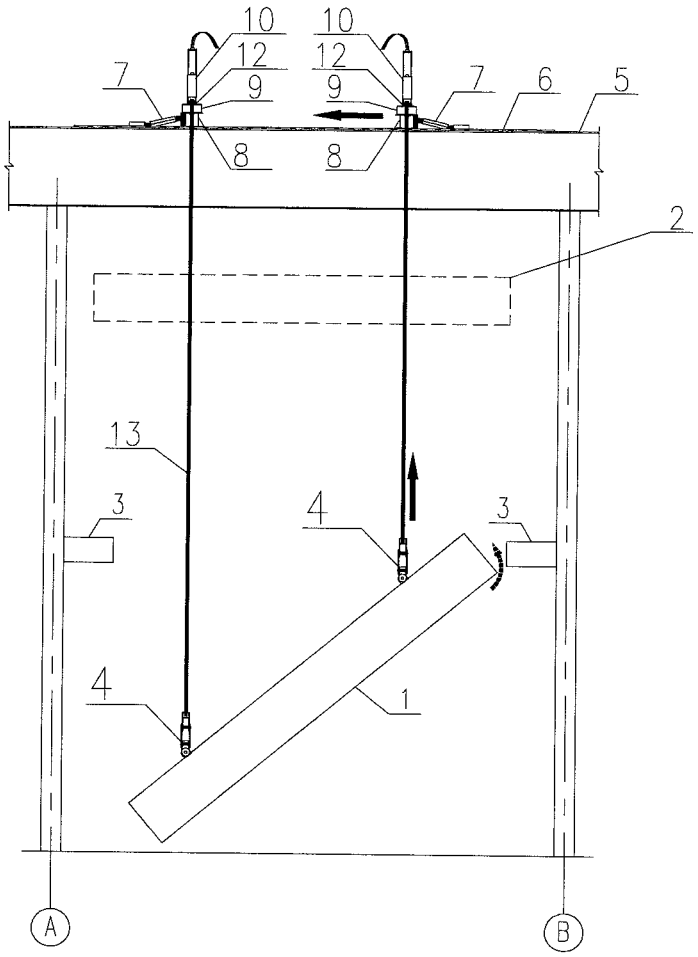
FIG. 2 is an A-A view of FIG. 1.
Figure 3:
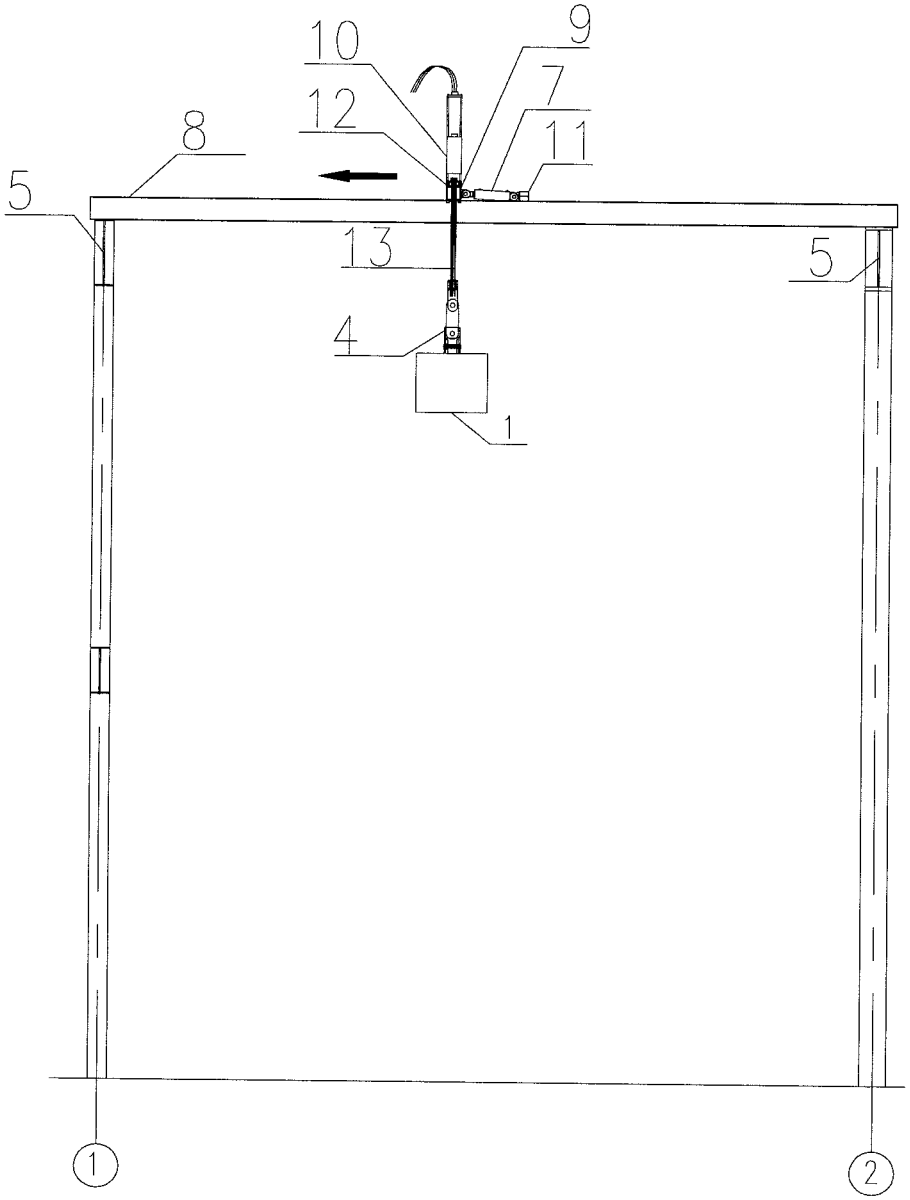
FIG. 3 is a B-B view of FIG. 1.

1 structure to be lifted
2 target position
3 obstacle in vertical direction
4 lifting lug
5 platform beam
6 slide rail
61 slide groove
62 slider
7 first hydraulic push instrument kit
8 lifting beam
81 connecting ear-plate on lifting beam
9 shoulder beam
91 via hole
92 connecting ear-plate
93 bound plate
10 hydraulic lifter
11 base of push instrument kit
111 base body of push instrument kit
112 expansion member
113 ear-plate
12 rotatable support
121 spherical convex
122 load-bearing member
13 steel strand
14 baffle
15 second push instrument kit

DETAILED EMBODIMENTS

As shown in FIGS. 1 to 4, a construction apparatus for lifting a structure integrally over obstacles in a vertical direction to a position with different horizontal projection, according to the present invention, comprises two platform beams 5 that are placed parallel to each other at a certain distance, two lifting beams 8 disposed laterally relative to the platform beams and placed on platform beams 5, and hydraulic lifters 10 that are equipped on the lifting beams 8. A plurality of pairs of baffles 14 are installed on both sides of slide rails 6 of the platform beams 5, as well as on a top surface of the lifting beams 8. An interval between each pair of baffles 14 corresponds with a pace of the push instrument kit 15.

A slide rail 6 is arranged between the platform beam 5 and the lifting beam 8 in order to facilitate movement of the lifting beam 8. The hydraulic lifter 10 is welded onto the shoulder beam 9. One or more first push instrument kits 7 are installed on the platform beam 5, each first push instrument kit including a head connected to a connecting ear-plate 81 of the lifting beam 8, a body, and a base 11 used to connect to and sustain the body. The base 11 of the first push instrument kit is supported on the baffles 14 installed on the platform beam 5, and the baffles 14 could provide the first push instrument kit 7 with a counter-force to push the lifting beam forward when the first push instrument kit 7 works. Meanwhile, the interval between adjacent baffles 14 matches with a pace of the hydraulic push instrument kit 7. One or more second hydraulic push instrument kits 15 are placed on the lifting beam 8. The head of the push instrument kit is connected to the connecting ear-plate 92 of the shoulder beam 9, and the body of the push instrument kit is connected to the base 11 of the push instrument kit which is supported on the corresponding baffles 14 installed on the lifting beam 8, and the baffles 14 could provide the second push instrument kit 15 with a counter-force to push the shoulder beam 9 forward when the second push instrument kit 15 works, meanwhile, the interval between adjacent baffles 14 matches with a pace of the hydraulic push instrument kit 15. Therefore, the structure 1 to be lifted can horizontally move freely under the act of the first and second push instrument kits.

A steel strand 13 of the hydraulic lifter 10 is connected to the lifting lug 4 configured at the structure 1 to be lifted. This is because it can prevent the steel strand 13 from folding while lifting the structure 1, and be convenient to load or unload the structure.

Further, in order to prevent the steel strand 13 from folding slightly and damaging while lifting the structure 1, due to the construction's delay relative to the move of the hydraulic lifter 10, a rotatable support 12 is arranged between the shoulder beam 9 and the lifter 10.

Figure 4:
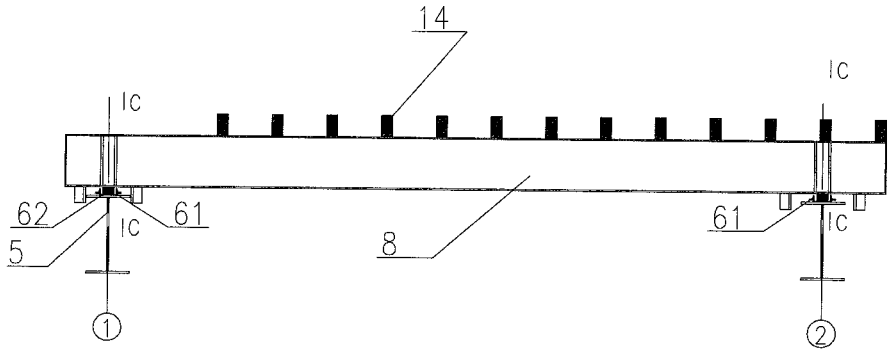
FIG. 4 is a schematic view of the lifting beam according to the present invention.
Figure 5:
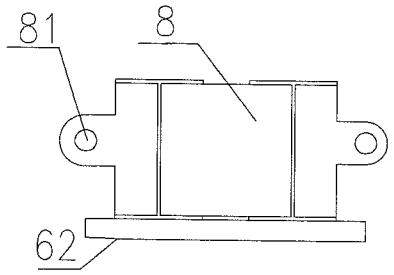
FIG. 5 is a C-C view of FIG. 4.
Figure 6:
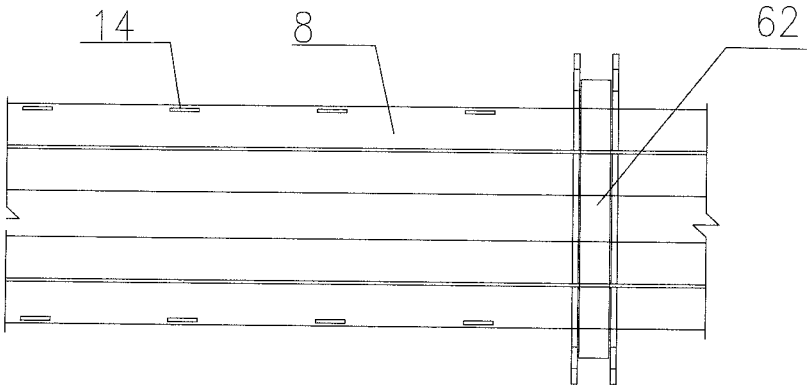
FIG. 6 is a top view of FIG. 4.

As shown in FIGS. 4 to 6, the slide rail 6 between the platform beam 5 and the lifting beam 8 comprises a slide groove 61 fixed to the platform beam 5, and a slider 62 fixed to the lifting beam. The slider 62 can be slid in the slide groove 61. The accessible area between the slider 62 and the slide groove is smooth plane with polishing treatment and lubricating grease.

The lifting beams 8 are double-beams structured in which each is configured as "工"-shaped at a certain distance where the steel strand 13 of hydraulic lifter 10 could pass through, ear-plates 81 used to connect to the first push instrument kits 7 are arranged on the lifting beams 8, and spread outward.

Figure 7:
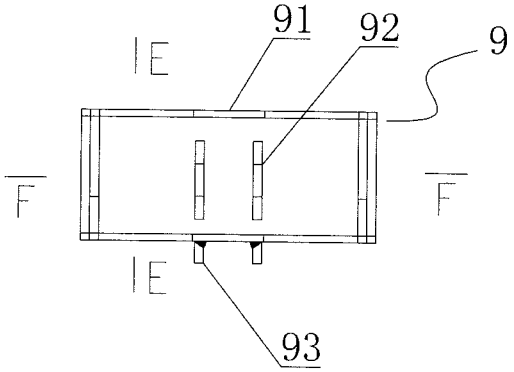
FIG. 7 is a schematic view of the shoulder beam according to the present invention.
Figure 8:
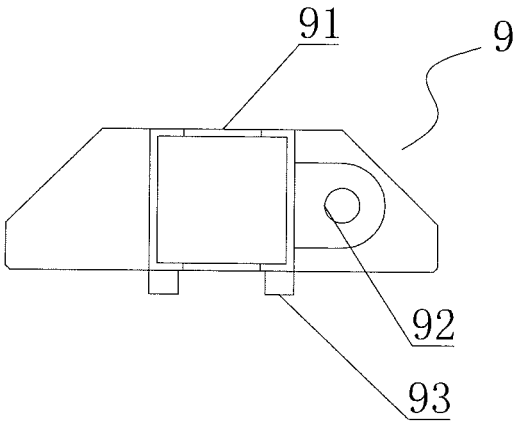
FIG. 8 is an E-E view of FIG. 7.
Figure 9:
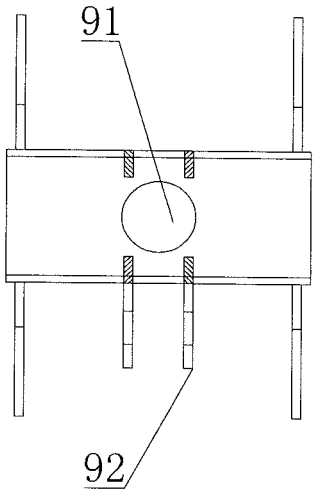
FIG. 9 is an F-F view of FIG. 7.

As shown in FIGS. 7 to 9, the shoulder beam 9 is a box structure equipped with a via hole 91, the connecting ear-plates 92 and the bound plates 93, wherein a steel strand 13 can pass through the via hole 91, and the connecting ear-plate 92 is configured at the sides of the box structure and spread outward to connect to the second push instrument kit 15, and bound plates 93 are configured at the bottom of the box structure so as to prevent steel strand 13 from folding when it pass through the via hole 91.

Figure 10:
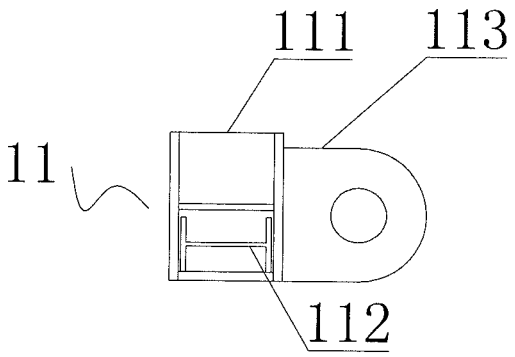
FIG. 10 is a schematic view of base of the push instrument kit according to the present invention.
Figure 11:
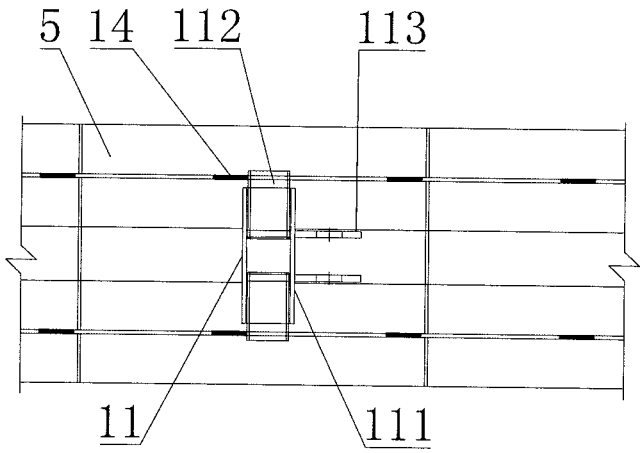
FIG. 11 is a top view of the base of the push instrument kit in use according to the present invention.

As shown in FIGS. 10 to 11, the base of the push instrument kit 11 comprises a base body 111, expansion members 112 placed at both sides of the base body, and ear-plates 113 spread outward from the base body 111 that used to connect to the push instrument body. The base body 111 of the push instrument kit is "H"-shaped and its width is less than the distance between each pair of baffles 14 set on both sides of platform beam. The expansion members 112 are also "H"-shaped and extend outward to support on the baffles 14 on both sides of platform beam.

Figure 12:
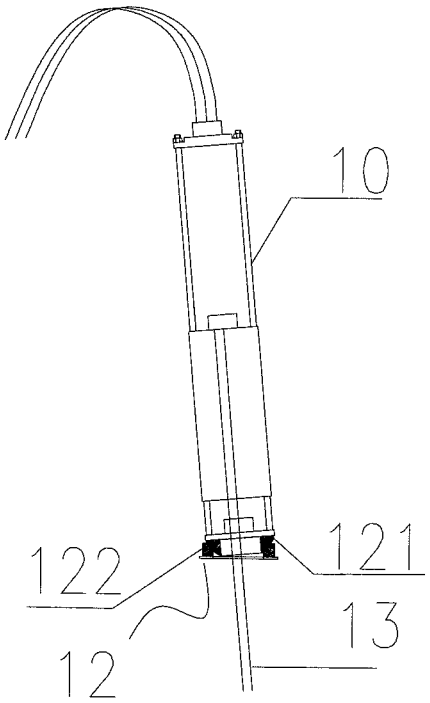
FIG. 12 is a schematic view of rotatable support between the hydraulic lifter and the shoulder beam according to the present invention.

As shown in FIG. 12, said rotatable support 12 comprises a spherical convex 121 fixed to the base of hydraulic lifter 10, and a load-bearing member 122 fixed to the surface of the shoulder beam 9. The load-bearing member has a spherical concave facing to and matching with the spherical convex 121. When the lifter 10 moves, the construction would be delayed relative to the move of the hydraulic lifter 10, and the steel strand 13 would be folded slightly. However, the spherical convex 121 will rotate freely in the spherical concave under the act of the steel strand 13, the hydraulic lifter 10 will adjust the steel strand 13 to be vertical, and prevent the steel strand 13 from damaging.

A method for lifting a structure integrally over obstacles in vertical direction to a position having a different horizontal projection, comprises:

(1) assembling the structure 1 to be lifted on the proper position of a construction site and setting lifting lugs 4 onto the suitable positions of the structure 1 according to the construction requirements;

(2) arranging two platform beams 5 longitudinally above the structure 1 to be lifted, setting a slide rail 6 to each platform beam 5, and fixing a slide groove 61 to each platform beam 5;

(3) placing two lifting beams 8 on the platform beams 5 laterally, fixing a slider 62 onto the bottom of the lifting beam 8, and the slider 62 will be placed into the slide groove 61 correspondently;

(4) installing the first hydraulic push instrument kits 7 on the platform beams 5, wherein the head of the push instrument kit 7 is connected to the lifting beam 8, the body of the push instrument kit 7 is connected to the base 11 of the push instrument kit 7 which is support on the corresponding baffles 14 on both sides of platform beam 5;

(5) installing shoulder beams 9 and second hydraulic push instrument kits 15 onto the lifting beams 8, wherein the head of the push instrument kit 15 is connected to the shoulder beam 9, the body of the push instrument kit 15 is connected to the base 11 of push instrument kit 15 which is supported on the corresponding pair of baffles 14 on the lifting beam 8, and a hydraulic lifter 10 is arranged on the shoulder beam 9;

(6) connecting the hydraulic lifter 10 to the lifting lug 4 on the structure 1 to be lifted by means of a lifting steel strand 13, while lifting the structure 1, the height between both ends of the structure 1 can be increased, and the horizontal projection of the structure 1 will be reduced only if adjusting the hydraulic lifters 10 arranged at two lifting beams 8 and the first hydraulic push instrument kits 7 at two platform beams 5, such that the posture of the structure 1 can be altered and the structure 1 can therefore be lifted over the obstacle in vertical direction;

(7) adjusting the height and the horizontal projection once again by operating the hydraulic lifters 10 and the first hydraulic push instrument kits 7 after the structure 1 has already be crossed over the obstacle, and making the structure 1 to be horizontal, then the structure 1 can be lifted to a target height thereafter;

(8) moving the structure 1 to a desired position by operating second hydraulic push instrument kits 15, each pace of the hydraulic push instrument kits 15 should match with the interval between two adjacent baffles 14 installed on the lifting beam 8. Once the push instrument kit 15 works to push at the shoulder beam 9 for a strock, two expansion members 112 placed at both sides of the base body of the push instrument kit 15 will be retracted, such that the push instrument kit 15 can be taken out to next strock, and two expansion members 112 spread outward again to support on the next baffles 14 on the next stroke, and the push instrument kit 15 works again to push at the shoulder beam 9. Such operation can proceed subsequently, until the structure 1 reaches its desired horizontal position; and (9) adjusting the structure 1 slightly by means of hydraulic lifter 10, and completing installation of the structure 1.

The embodiment described hereinbefore is merely a preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A method of using a construction apparatus, comprising:

assembling a structure to be lifted on a construction site and setting lifting lugs onto the structure to be lifted according to construction requirements;

arranging two platform beams longitudinally above the structure to be lifted, setting a slide rail to each of the platform beams, and each slide rail comprises a slide groove;

placing two lifting beams on the platform beams laterally, and fixing a slider onto a bottom of each of the two lifting beams, with the slider being received in the slide groove;

installing first hydraulic push instrument kits on each of the two platform beams, wherein a head of one of the first hydraulic push instrument kits is connected to a respective one of the lifting beams, a body of one of the first push instrument kits is connected to a base of one of the first push instrument kits which is supported by a corresponding pair of baffles on both sides of the slide rail;

installing a shoulder beam and a second hydraulic push instrument kit onto each of the lifting beams, wherein a head of the second push instrument kit is connected to the shoulder beam, a body of the second push instrument kit is connected to a base of the second push instrument kit which is supported on a corresponding pair of baffles on each of the lifting beams, and arranging a hydraulic lifter on the shoulder beam;

connecting the hydraulic lifter to a lifting lug on the structure to be lifted by a lifting steel strand;

adjusting a height difference and a horizontal projection between lifting points on both ends of the structure to be lifted by operating the hydraulic lifter and the first hydraulic push instrument kits to lift the structure to be lifted over an obstacle, and making the structure to be horizontal after crossing over the obstacle, then the structure to be lifted can be lifted to a target height thereafter;

moving the structure to be lifted to a desired position by operating the second hydraulic push instrument kit, each pace of the second hydraulic push instrument kit matching with an interval between two adjacent baffles installed on each of the lifting beams; once the second push instrument kit work to push at the shoulder beam for a stroke, two expansion members placed at both sides of the base body of the second push instrument kit will be retracted, such that the second push instrument kit can be taken out to next stroke, and the two expansion members spread outward again to support on next pair of baffles on the next stroke, and the second push instrument kit work again to push at the shoulder beam; such operation can proceed subsequently, until the structure to be lifted reaches its desired horizontal position; and adjusting the structure to be lifted by the hydraulic lifter.

* * * * *